United States Patent [19]

Rhodes

[11] 4,177,135

[45] Dec. 4, 1979

[54] USE OF SPECIFIC COAL COMPONENTS TO IMPROVE SOLUBLE COAL PRODUCT YIELD IN A COAL DEASHING PROCESS

[75] Inventor: Donald E. Rhodes, Oklahoma City, Okla.

[73] Assignee: Kerr-McGee Corporation, Oklahoma City, Okla.

[21] Appl. No.: 887,926

[22] Filed: Mar. 20, 1978

[51] Int. Cl.[2] ..... C10G 21/14

[52] U.S. Cl. ..... 208/177

[58] Field of Search ..... 208/177, 8; 210/21, 210/22

[56] References Cited

U.S. PATENT DOCUMENTS

| | | | |
|---|---|---|---|
| 3,607,716 | 9/1971 | Roach | 208/8 |
| 3,607,717 | 9/1971 | Roach | 208/8 |
| 3,642,608 | 2/1972 | Roach et al. | 208/8 |
| 3,661,774 | 3/1978 | Masologites | 210/21 |
| 3,954,595 | 5/1976 | Sze et al. | 208/8 |
| 4,040,957 | 8/1977 | Sze et al. | 208/8 |
| 4,070,268 | 1/1978 | Davis et al. | 208/8 |
| 4,077,881 | 3/1978 | Snell | 208/8 |

*Primary Examiner*—George Crasanakis
*Attorney, Agent, or Firm*—William G. Addison

[57] ABSTRACT

A process for improving the yield of soluble coal products separated from a residuum feed in a coal deashing process. In operation, an additive comprising (i) at least a portion of a distillate fraction preferably recovered from the coal liquefaction products from which the residuum feed is derived, (ii) a portion of recycled heavy soluble coal products, (iii) a portion of recycled light soluble coal products, or (iv) admixtures thereof is introduced in predetermined quantities into the residuum feed prior to entry into a separation zone maintained at elevated temperature and pressure to effect an improved separation of the soluble coal products from the insoluble coal products within the residuum feed.

14 Claims, 3 Drawing Figures

USE OF SPECIFIC COAL COMPONENTS TO IMPROVE SOLUBLE COAL PRODUCT YIELD IN A COAL DEASHING PROCESS

BACKGROUND OF THE INVENTION

1. Field of the Invention

The present invention relates generally to coal deashing processes and, more particularly but not by way of limitation to improved separation techniques in coal deashing processes.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717 issued to Roach and assigned to the same assignee as the present invention, disclose processes wherein coal is contacted with a solvent and the resulting mixture then is separated into a heavy phase containing the insoluble coal products and a light phase containing the soluble coal products. Other processes for separating the soluble coal products from the insoluble coal products present in coal liquefaction products utilizing one or more solvents are disclosed in U.S. Pat. Nos. 3,607,718 and 3,642,608, both issued to Roach et al., and assigned to the same assignee as the present invention.

While those processes provide a means for substantially separating the soluble coat products from the insoluble coal products, some soluble coal products still are separated with the insoluble materials in the heavy phase. It would be desirable to provide a process to further increase the yield of recoverable soluble coal products by reducing the quantity of soluble coal products separated with the insoluble materials.

SUMMARY OF THE INVENTION

The discovery now has been made that the process to be hereinafter described effects an improved separation of soluble coal products from insoluble coal products. In operation, coal liquefaction products are introduced into a distillation zone wherein the volatile products of the coal liquefaction products are substantially separated and recovered as separate products to leave a residuum feed comprising soluble coal products and insoluble coal products. The residuum feed is introduced into a mixing zone wherein it is contacted with a solvent and an additive comprising at least a portion of the separated volatile products to form a feed mixture. Alternatively, the additive can be introduced into the feed prior to introduction of said feed into the mixing zone or into the solvent prior to introduction of said solvent into the mixing zone.

The feed mixture is withdrawn from the mixing zone and introduced into a first separation zone maintained at elevated temperature and pressure to effect a separation of the mixture into a first light phase comprising soluble coal products and solvent and a first heavy phase comprising insoluble coal products and some solvent.

The first heavy phase is withdrawn from the first separation zone and treated to recover the solvent therefrom, for recycle to the mixing zone.

The first light phase is withdrawn and introduced into a second separation zone. The second separation zone is maintained at a temperature level higher than the temperature in the first separation zone and a pressure level substantially no greater than the pressure in the first separation zone to effect a separation of the first light phase into a second light phase comprising light soluble coal products and solvent and a second heavy phase comprising heavy soluble coal products.

The second light phase is withdrawn from the second separation zone and introduced into a third separation zone. In an alternate embodiment a portion of the second light fraction can be withdrawn for use as an additive, mixed with additional solvent and recycled to the mixing zone.

The third separation zone is maintained at an elevated temperature and pressure level to effect a separation of the second light phase into a third light phase and a third heavy phase.

The third light phase comprising solvent is withdrawn from the third separation zone for recycle to the mixing zone.

The third heavy phase comprising light soluble coal products and some solvent is withdrawn from the third separation zone and treated to separately recover the light soluble coal products and the solvent. The recovered solvent may be recycled to the mixing zone to aid in providing the feed mixture.

The second heavy phase is withdrawn from the second separation zone and treated to separately recover the heavy soluble coal products and the solvent. The recovered solvent may be recycled to the mixing zone to aid in providing the feed mixture.

The addition of the additive results in an improved yield of the soluble coal products from the residuum feed over the yield that is obtained through practice of the deashing process without the additive.

In an alternate embodiment a portion of either or both the recovered heavy soluble coal products and the recovered light soluble coal products may be recycled as an additive to mix with the feed prior to introduction into the mixing zone. Alternatively, the portion of heavy soluble coal products, light soluble coal products or a mixture of both may be introduced into the mixing zone or it may be introduced into the recycle solvent stream prior to introduction into the mixing zone.

The addition of the various additives results in an improved yield of soluble coal products from the residuum feed over the yield that is obtained through practice of the deashing process without the additives.

In another embodiment, two sequential deashing separations are performed such that the first heavy phase is withdrawn from the first separation zone, mixed with additional solvent and additives to form a mixture and introduced into another separation zone. The additional separation zone is maintained at an elevated temperature and pressure level to effect a separation of the mixture into a light phase and a heavy phase.

The light phase is withdrawn and recycled to the first mixing zone to contact the feed therein and reenter the first separation zone.

The heavy phase is withdrawn and treated to recover the solvent for recycle to the mixing zones.

The various additions of additives is as previously described and additives also can be introduced into the withdrawn first heavy phase prior to the second sequential separation. The presence of the additives results in an improved yield of soluble coal products from the residuum feed over the yield that is obtained without the presence of the additives.

DESCRIPTION OF THE PREFERRED EMBODIMENT

Figure 1:
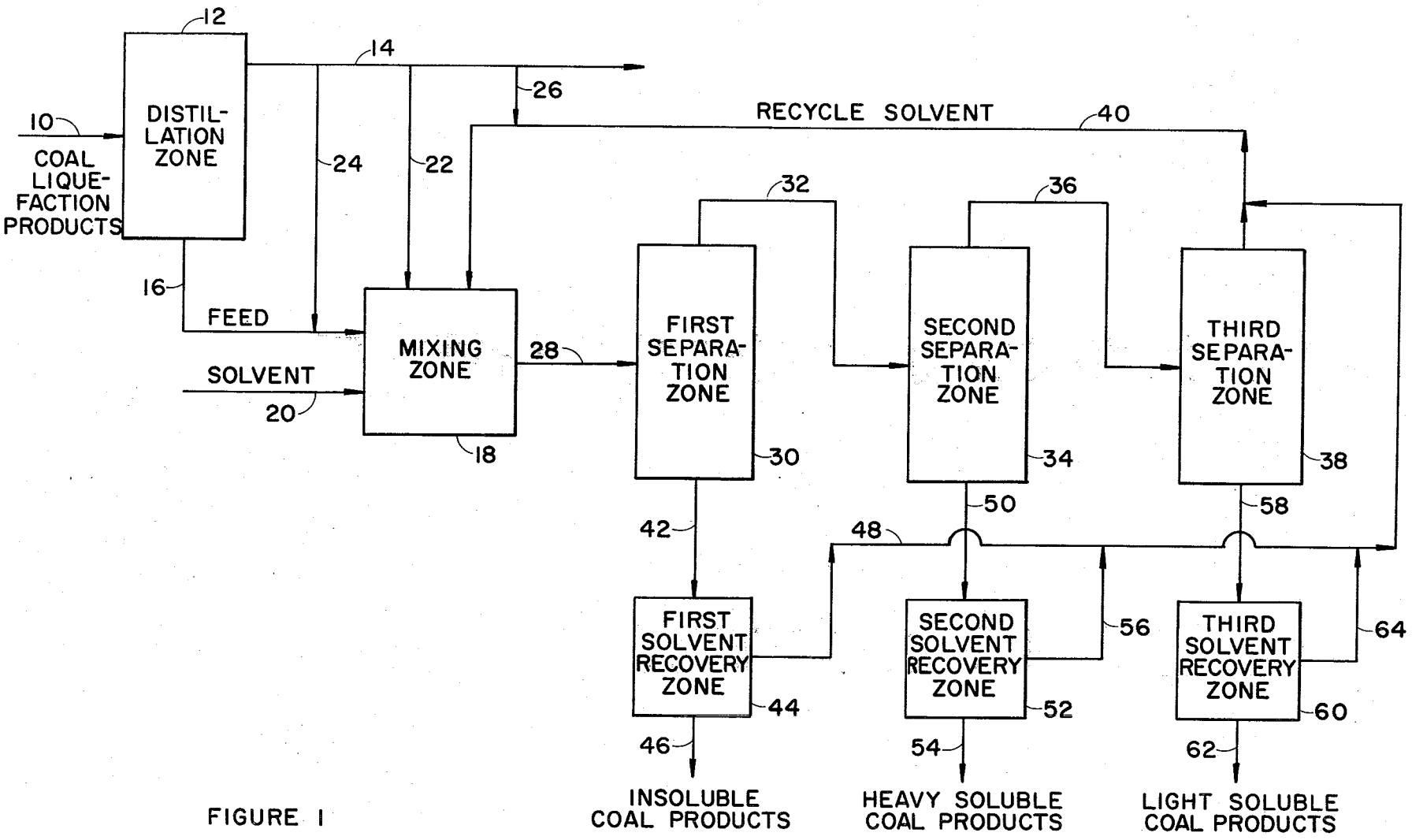
FIG. 1 is a diagrammatic, schematic illustration of the process of the present invention.

Turning now to FIG. 1, coal liquefaction products flowing in a conduit 10 are introduced into a distillation zone 12. The coal liquefaction products can be produced by any process wherein carbonaceous materials are treated to effect a solubilization of at least a part of said materials. The distillation zone 12 is operated to separate and recover volatile coal products from the coal liquefaction products and leave a residuum comprising soluble coal products and insoluble coal products. The distillation zone may include a vacuum or atmospheric distillation vessel. The distillation zone also includes means by which the volatile products can be separated into a number of separate fractions.

The volatile products are withdrawn from the distillation zone 12 through a conduit 14. In those instances in which the volatile products are separated into a number of individual fractions, each individual fraction is withdrawn through a separate conduit, said multiple conduits being represented generally by conduit 14 (in FIG. 1).

The residuum is withdrawn from the distillation zone 12 through a conduit 16 to enter a mixing zone 18. The residuum is the feed to the coal deashing process of this invention.

In mixing zone 18, the residuum feed is contacted and mixed with a solvent entering the mixing zone 18 through a conduit 20 to form a feed mixture. Sufficient solvent is introduced into the mixing zone 18 to provide a ratio by weight of solvent to feed in the feed mixture of from about 1:1 to about 10:1. It is to be understood that larger quantities of solvent can be used, however such use is uneconomical. In addition to the feed and solvent introduced into the mixing zone 18, an additive flowing in a conduit 22 is introducted into the mixing zone 18 to contact and mix with the feed and solvent. The additive comprises at least a portion of at least one of the distillate fractions withdrawn through conduit 14 from the distillation zone 12. At least a portion of the additive comprises a separated fraction of the coal liquefaction products which could not have been retained within the residuum while the remaining volatile products were separated and recovered. Further, at least a portion of the distillate fraction comprising the additive comprises a substance which exhibits the characteristics of a Lewis base in that the substance comprises an electron pair donor capable of forming coordinate covalent bonds with constituents in the residuum feed.

Alternatively, the additive may be introduced into the feed in conduit 16 through a conduit 24 to mix with the feed prior to introduction into the mixing zone 18 or the additive may be introduced into the solvent through a conduit 26 to mix with the solvent prior to introduction into the mixing zone 18.

The feed mixture including the additive is discharged from the mixing zone 18 through a conduit 28 to enter a first separation zone 30. The first separation zone 30 is maintained at an elevated temperature and pressure level to effect a separation of the feed mixture into a first light phase and a first heavy phase. More particularly, the first separation zone 30 is maintained at a temperature level in the range of from about 400 degrees F. to about 700 degrees F. and a pressure level in the range of from about 600 psig to about 1500 psig.

The first light phase comprising soluble coal products, additive and solvent is withdrawn from the first separation zone through a conduit 32 to enter a second separation zone 34.

While the mechanism of the process is not fully understood, it has been found that when the feed and solvent are admixed with additive in the predetermined quantities hereinafter set forth, prior to introduction into the first separation zone 30, the yield of soluble coal products recovered from the coal deashing process is improved over the yield that is obtained when the additive is not present. It is believed the additive interacts with the solvent and the feed to extract additional soluble coal products from the insoluble coal products contained therein by a leaching action. The leaching is believed to be effected by the formation of coordinate covalent bonds between substances which exhibit the characteristics of Lewis bases contained in the additive and various coal constituents contained in the residuum feed as insoluble components. The covalently bonded compounds are more soluble than the various coal constituents in the insoluble components of the residuum feed and are extracted into the solvent in the separation zone. A substantial improvement in the yield of soluble coal products is found to occur when the additive is present in sufficient quantity to provide a ratio by weight of residuum feed to additive in the range of from about 1:5 to about 20:1. Preferably the ratio of feed to additive is in the range of from about 1:1 to about 15:1.

The second separation zone 34 is maintained at a temperature level above the temperature level within the first separation zone 30 and a pressure level substantially no greater than the pressure level in the first separation zone 30 to effect a separation of the first light phase into a second light phase and a second phase. More particularly, the temperature level is maintained in the range of from about 450 degrees F. to about 800 degrees F.

The second light phase comprising light soluble coal products, additive and solvent is withdrawn from the second separation zone 34 through a conduit 36 to enter a third separation zone 38.

The third separation zone 38 is maintained at a temperature level higher than the temperature level within the second separation zone 34 and a pressure level substantially no greater than the pressure level in the second separation zone 34 to effect a separation of the second light phase into a third light phase and a third heavy phase. More particularly, the temperature level in the third separation zone 38 is maintained in the range of from about 500 degrees F. to about 950 degrees F.

In an alternate embodiment, the third separation zone 38 may comprise a flash vessel. In this event, the second light phase is flashed to form at least one stream comprising light soluble coal products and one other overhead stream comprising solvent and additive.

The third light phase comprising solvent and additive is withdrawn from the third separation zone 38 through a conduit 40 for recycle to the mixing zone 18.

The first heavy phase comprising insoluble coal products and some solvent is withdrawn from the first separation zone through a conduit 42 and introduced into a first solvent recovery zone 44. Preferably, first solvent recovery zone 44 comprises a flash vessel.

In the first solvent recovery zone 44, the first heavy phase is treated to effect a separation of the first heavy phase into at least one stream comprising insoluble coal products and one other overhead stream comprising solvent.

The insoluble coal products stream is withdrawn from the first solvent recovery zone through a conduit 46 for introduction into subsequent processing apparatus (not shown). The solvent stream is withdrawn from the first solvent recovery zone 44 through a conduit 48 for eventual recycle to the mixing zone 18.

The second heavy phase comprising heavy soluble coal products and some solvent is withdrawn from the second separation zone 34 through a conduit 50 and introduced into a second solvent recovery zone 52. Preferably, the second solvent recovery zone 52 comprises a flash vessel.

In the second solvent recovery zone 52, the second heavy phase is treated to effect a separation of the second heavy phase into at least one stream comprising heavy soluble coal products and one other overhead stream comprising solvent.

The heavy soluble coal products stream is withdrawn from the second solvent recovery zone 52 through a conduit 54 and recovered. The solvent stream is withdrawn from the second solvent recovery zone 52 through a conduit 56 for eventual recycle to the mixing zone with other recovered solvent.

The third heavy phase comprising light soluble coal products, some additive and some solvent is withdrawn from the third separation zone 38 through a conduit 58 and introduced into a third solvent recovery zone 60. The third solvent recovery zone 60 can comprise a flash vessel or a fractional distillation vessel or the like.

In the third solvent recovery zone 60, the third heavy phase is treated to effect a separation of the third heavy phase into at least one stream comprising light soluble coal products and one other overhead stream comprising solvent and additive. The solvent and additive also may be separated in some instances into separate streams within the third solvent recovery zone 60.

The solvent stream is withdrawn from the third solvent recovery zone 60 through a conduit 64 for eventual recycle to the mixing zone 18 with other recovered solvent.

The light soluble coal products are withdrawn from the third solvent recovery zone 60 through a conduit 62 and recovered. In those instances in which the additive is separated from the light soluble coal products and the solvent within the third solvent recovery zone 60, the additive can be withdrawn through a separate conduit (not shown) and, if desired, the additive can be recycled to contact additional feed.

The term "solvent" as used herein is intended to mean those fluids which are sometimes described as "light organic solvents," for example, in U.S. Pat. Nos. 3,607,716 and 3,607,717, the disclosures of which are incorporated herein by reference. More specifically, the solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain monoolefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The term "insoluble coal products" means undissolved coal, mineral matter, other solid inorganic particulate matter and other such matter which is insoluble in the solvent under the operating conditions of the present invention.

The term "soluble coal products" means the materials within the feed that are soluble in the solvent under the operating conditions of the present invention. The term "heavy soluble coal products" means a portion of the soluble coal product having a density greater than the average density of the soluble coal product and solvent mixture from which it is separated. The term "light soluble coal products" means a portion of the soluble coal products having a density less than the average density of the soluble coal products and solvent mixture from which it is separated.

Figure 2:
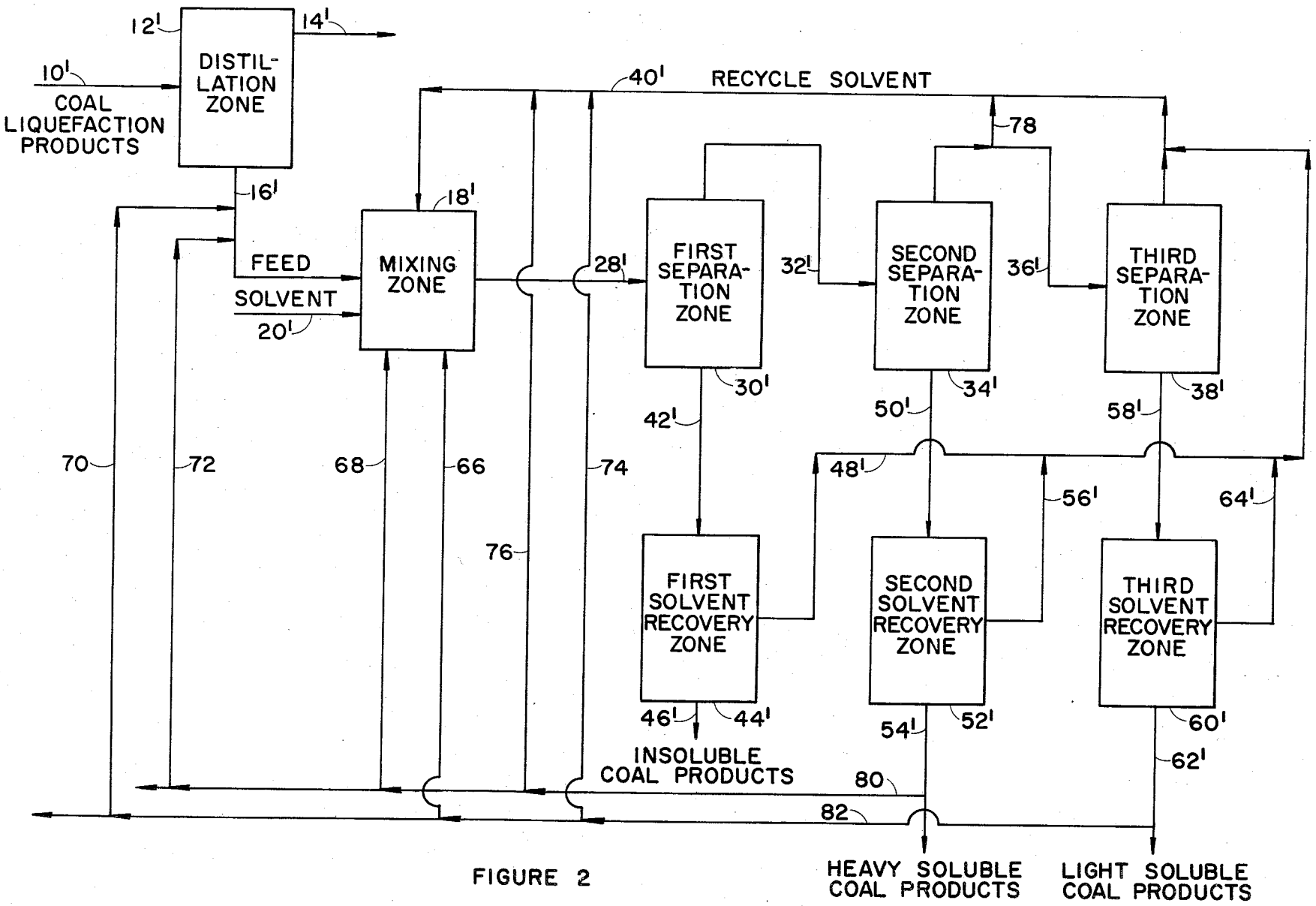
FIG. 2 is a diagrammatic, schematic illustration of another embodiment of the present invention.

Turning now to FIG. 2, another embodiment of the present invention is illustrated. The coal liquefaction products flowing in a conduit 10′ are introduced into a distillation zone 12′ and treated to separate the volatile coal products and leave a residuum comprising soluble coal products and insoluble coal products. The residuum is withdrawn from the distillation zone 12′ and introduced into a mixing zone 18′ via a conduit 16′. Solvent is introduced as previously described into the mixing zone 18′ through a conduit 20′ to contact and mix with the feed to provide a feed mixture. An additive comprising either a portion of recovered heavy soluble coal products or recovered light soluble coal products or a mixture of both is introduced into the mixing zone 18′ through either a conduit 66 or a conduit 68 or both respectively, to contact and mix with the feed and solvent contained therein. Alternatively, either the portion of heavy soluble coal products or the portion of light soluble coal products or the mixture of both can be introduced into the feed in conduit 16′ prior to introduction into the mixing zone 18′ through a conduit 70 or a conduit 72 respectively, or either or both can be introduced into the solvent in conduit 40′ prior to introduction into the mixing zone 18′ through a conduit 74 or a conduit 76 respectively.

The feed mixture including the additive is discharged from the mixing zone 18′ through a conduit 28′ to enter a first separation zone 30′. The first separation zone 30′ is maintained at an elevated temperature and pressure level to effect a separation of the feed mixture into a first light phase and a first heavy phase. More particularly, the first separation zone 30′ is maintained at a temperature level in the range of from about 400 degrees F. to about 700 degrees F. and a pressure level in the range of from about 600 psig to about 1500 psig.

The first light phase comprising soluble coal products, additive and solvent is withdrawn from the first separation zone 30′ through a conduit 32′ to enter a second separation zone 34′.

While the mechanism of this process embodiment also is not fully understood, it is believed to be at least partially similar to the mechanism wherein the additive is a fraction of the volatile products separated from the coal liquefaction products prior to deashing of the residuum. The presence of the recycled soluble coal products increases the solubility of the residuum feed in the solvent such that a greater yield of soluble coal products is obtained from the coal deashing process than is possible without the presence of the recycled soluble coal products. As previously indicated, a substantial improvement in the yield of soluble coal products is found to occur when the additive is present in sufficient quantity to provide a ratio by weight of residuum feed to additive in the range of from about 1:5 to about 20:1. Preferably, the ratio of feed to additive is in the range of from about 1:1 to about 15:1.

The second separation zone 34' is maintained at a temperature level above the temperature level within the first separation zone 30' and a pressure level substantially no greater than the pressure level in the first separation zone 30' to effect a separation of the first light phase into a second light phase and a second heavy phase. More particularly, the temperature level is maintained in the range of from about 450 degrees F. to about 800 degrees F.

The second light phase comprising light soluble coal products, additive and solvent is withdrawn from the second separation zone 34' through a conduit 36' to enter a third separation zone 38'.

A portion of the second light phase comprising the light soluble coal products and solvent can be withdrawn from conduit 36' through a conduit 78 for eventual recycle to the mixing zone 18' through connection with conduit 40' in lieu of introducing a portion of the recovered light soluble coal products into the feed through conduits 66, 70 or 74. Alternatively the portion of the withdrawn second light phase may be recycled to the mixing zone 18' in combination with either recycle of recovered light soluble coal products or recovered heavy soluble coal products or both.

The third separation zone 38' maintained at a temperature level higher than the temperature level within the second separation zone 34' and a pressure level substantially no greater than the pressure level in the second separation zone 34' to effect a separation of the second light phase into a third light phase and a third heavy phase. More particularly, the temperature level in the third separation zone 38' is maintained in the range of from about 500 degrees F. to about 950 degrees F.

In an alternate embodiment, the third separation zone 38' may comprise a flash vessel. In this event, the second light phase is flashed to form at least one stream comprising light soluble coal products and one other overhead stream comprising solvent.

The third light phase comprising solvent is withdrawn from the third separation zone 38' through a conduit 40' for recycle to the mixing zone 18'.

The first heavy phase comprising insoluble coal products and some solvent is withdrawn from the first separation zone through a conduit 42' and introduced into a first solvent recovery zone 44'. Preferably, first solvent recovery zone 44' comprises a flash vessel.

In the first solvent recovery zone 44', the first heavy phase is treated to effect a separation of the first heavy phase into at least one stream comprising insoluble coal products and one other overhead stream comprising solvent.

The insoluble coal products stream is withdrawn from the first solvent recovery zone through a conduit 46' for introduction into subsequent processing apparatus (not shown). The solvent stream is withdrawn from the first solvent recovery zone 44' through a conduit 48' for eventual recycle to the mixing zone 18'.

The second heavy phase comprising heavy soluble coal products and some solvent is withdrawn from the second separation zone 34' through a conduit 50' and introduced into a second solvent recovery zone 52'. Preferably, the second solvent recovery zone 52' comprises a flash vessel.

In the second solvent recovery zone 52', the second heavy phase is treated to effect a separation of the second heavy phase into at least one stream comprising heavy soluble coal products and one other overhead stream comprising solvent.

The heavy soluble coal products stream is withdrawn from the second solvent recovery zone 52' through a conduit 54' and recovered. The solvent stream is withdrawn from the second solvent recovery zone 52' through a conduit 56' for eventual recycle to the mixing zone with other recovered solvent.

A portion of the withdrawn heavy soluble coal products in conduit 54' is withdrawn through a conduit 80. Any portion or all of the heavy soluble coal products flowing in conduit 80 can be introduced by any or all of the conduits 68, 72 and 76 to provide the additive or a part thereof for mixing with the feed and solvent.

The third heavy phase comprising light soluble coal products and some solvent is withdrawn from the third separation zone 38' through a conduit and introduced into a third solvent recovery zone 60'. The third solvent recovery zone 60' can comprise a flash vessel or a fractional distillation vessel or the like.

In the third solvent recovery zone 60', the third heavy phase is treated to effect a separation of the third heavy phase into at least one stream comprising light soluble coal products and one other overhead stream comprising solvent.

The solvent stream is withdrawn from the third solvent recovery zone 60' through a conduit 64' for eventual recycle to the mixing zone 18' with other recovered solvent. The light soluble coal products are withdrawn from the third solvent recovery zone 60' through a conduit 62' and recovered.

A portion of the withdrawn light soluble coal products in conduit 62' is withdrawn through a conduit 82. Any portion or all of the light soluble coal products flowing in conduit 82 can be introduced by any or all of the conduits 66, 70 and 74 to provide the additive or a part thereof for mixing with the feed and solvent.

In those instances wherein the additive comprises a portion of the recovered heavy soluble coal products, the additive is separated in the second separation zone 34' as a portion of the second heavy phase and eventually recovered.

In those instances wherein the additive comprises a portion of the recovered light soluble coal products, the additive is separated in the third separation zone 38' as a portion of the third heavy phase and eventually recovered.

If the additive is a mixture of heavy and light soluble coal products, the individual components of the additive are recovered in their respective separation zones in their respective heavy phases, as just described hereinabove.

Figure 3:
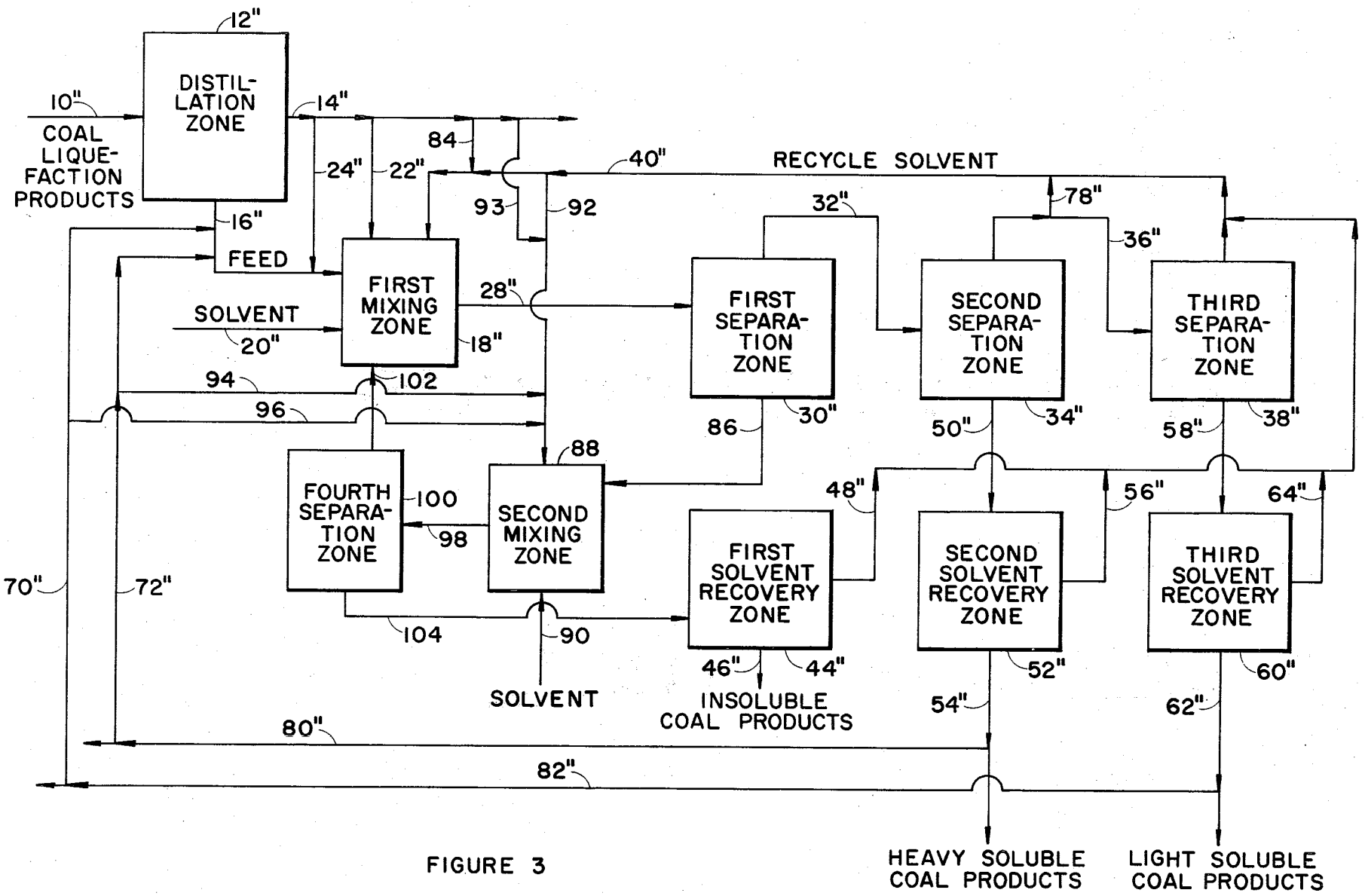
FIG. 3 is a diagrammatic, schematic illustration of yet another embodiment of the present invention.

Turning now to FIG. 3, another embodiment of the present invention is illustrated. The coal liquefaction products flowing in conduit 10'' are introduced into a distillation zone 12'' and treated to separate the volatile coal products and leave a residuum comprising soluble coal products and insoluble coal products. The residuum feed is withdrawn from the distillation zone 12'' and introduced into a first mixing zone 18'' via a conduit 16''. Solvent is introduced as previously described into the first mixing zone 18'' through a conduit 20'' to contact and mix with the feed to provide a feed mixture. An additive comprising (i) at least a portion of at least one of the distillate fractions withdrawn through a conduit 14'' from the distillation zone 12'', (ii) a portion of the recovered heavy soluble coal products withdrawn in a conduit 54'', (iii) a portion of the recovered light soluble coal products withdrawn in a conduit 62'' or (iv) a mixture thereof can be introduced into the feed prior to entry into a first separation zone 30'' through a conduit 28'' from the first mixing zone 18''. The additive, if a distillate fraction, can be introduced through any or all the conduits 22'', 24'' and a conduit 84; if a portion of the heavy soluble coal products, through a conduit 72''; and if a portion of the light soluble coal products, through a conduit 70''. The additive is introduced into the first mixing zone 18'' in sufficient quantity to be present in a ratio by weight of residuum feed to additive of from about 1:5 to about 20:1. Preferably the ratio of feed to additive is in the range of from about 1:1 to about 15:1.

The feed mixture including the additive is discharged from the first mixing zone 18'' through conduit 28'' into the first separation zone 30''. The first separation zone 30'' is maintained at a temperature level in the range of from about 400 degrees F. to about 700 degrees F. and a pressure level in the range of from about 600 psig to about 1500 psig to effect a separation of the feed mixture into a first light phase comprising soluble coal products, additive and solvent and a first heavy phase comprising insoluble coal products, some solvent and some soluble coal products.

The first light phase is withdrawn from the first separation zone 30'' through a conduit 32'' to enter a second separation zone 34''.

The second separation zone 34'' is maintained at a temperature level above the temperature level within the first separation zone 30'' and a pressure level substantially no greater than the pressure level in the first separation zone 30'' to effect a separation of the first light phase into a second light phase and a second heavy phase. More particularly, the temperature level is maintained in the range of from about 450 degrees F. to about 800 degrees F.

The second light phase comprising light soluble coal products, additive and solvent is withdrawn from the second separation zone 34'' through a conduit 36'' to enter a third separation zone 38''.

A portion of the second light phase comprising the light soluble coal products and solvent can be withdrawn from conduit 36'' through a conduit 78'' for eventual recycle to the mixing zone 18'' through connection with conduit 40'' in lieu of introducing a portion of the recovered light soluble coal products into the feed through conduits 66'', 70'' or 74''. Alternatively the portion of the withdrawn second light phase may be recycled to the mixing zone 18'' in combination with either recycle of recovered light soluble coal products or recovered heavy soluble coal products or both.

The third separation zone 38'' is maintained at a temperature level higher than the temperature level within the second separation zone 34'' and a pressure level substantially no greater than the pressure level in the second separation zone 34'' to effect a separation of the second light phase into a third light phase and a third heavy phase. More particularly, the temperature level in the third separation zone 38'' is maintained in the range of from about 500 degrees F. to about 950 degrees F.

In an alternate embodiment, the third separation zone 38'' may comprise a flash vessel. In this event, the second light phase is flashed to form at least one stream comprising light soluble coal products and one other overhead stream comprising solvent.

The third light phase comprising solvent is withdrawn from the third separation zone 38'' through a conduit 40'' for recycle to the mixing zone 18''.

The first heavy phase comprising insoluble coal products and some solvent is withdrawn from the first separation zone through a conduit 86, and introduced into a second mixing zone 88.

Solvent can be introduced into the second mixing zone 88 through a conduit 90. Sufficient solvent is introduced, if necessary, to provide a ratio by wieght of solvent to feed in the range of from about 3:1 to about 10:1. Larger amounts of solvent can be used, however such use is uneconomical. Preferably, solvent withdrawn from conduit 40'' through a conduit 92 is employed to supplant a portion if not all of the solvent required in the second mixing zone 88. The stream flowing in conduit 40'' also may comprise additive separated in the second separation zone 34'' or the third separation zone 38'' as the respective light phases. In one embodiment, the stream flowing in conduit 40'' can be introduced into a fraction zone (not shown) to separate the solvent and the additive contained therein. In such an event, the stream flowing in conduit 92 then may comprise either a solvent-rich stream or an additive-rich stream for introduction into the second mixing zone 88 as required. An additive is introduced into the second mixing zone 88 to contact and mix with the first heavy phase and solvent to form a second feed mixture. The additive, if a distillate fraction can be introduced into conduit 92 for entry into the second mixing zone 88 through a conduit 93; if a portion of the recovered heavy soluble coal products through a conduit 94; and if a portion of the recovered light soluble coal products through a conduit 96. The additive is present in sufficient quantity to provide a ratio by weight of residuum feed to additive in the range of from about 1:5 to about 10:1. The second feed mixture is discharged from the second mixing zone 88 through a conduit 98 into a fourth separation zone 100.

The fourth separation zone is maintained at an elevated temperature and a pressure level substantially no greater than the pressure level in the first separation zone 30'' to effect a separation of the second feed mixture into a fourth light phase and a fourth heavy phase. More specifically, the temperature level is maintained in a range of from about 200 degrees F. to about 700 degrees F. and the pressure level is in the range of from about atmospheric to about 1500 psig.

The fourth light phase comprising soluble coal products, additive and solvent is withdrawn from the fourth separation zone 100 and introduced into the first mixing zone 102 through a conduit 102.

The fourth heavy phase comprising insoluble coal products and some solvent is withdrawn from the fourth separation zone 100 and introduced into a first solvent recovery zone 44'' through a conduit 104.

The sequential separation performed upon the feed in first separation zone 30'' and fourth separation zone 100 with recycle of the fourth light phase containing additive back to the first separation zone 30'' effects and improved separation of the soluble coal products from the insoluble coal products in the residuum feed to the deashing process over that obtained in the absence of the additive. Further, the sequential separation permits the solvent to be contacted with the feed in either a cocurrent manner, a countercurrent manner or a combination of the contacting means such that the most effective interaction between the solvent, additive and feed can be obtained.

As previously described, while the mechanism of this invention is not completely understood, the addition of the additive, or various different additives at various locations within the deashing process has been found to provide an improved yield of soluble coal products from the residuum feed over that yield which is obtained without the presence of the additive. Further, the additive is not lost during the process except for miner losses which occur as a result of mechanical inefficiency in the apparatus and is capable of continuous recycle. A further advantage of this process is that the additive can be derived entirely from the products of a coal liquefaction process and thereby provides a most economical means of improving the yield of the coal deashing process.

In the first solvent recovery zone 44'', the fourth heavy phase is treated to effect a separation of the fourth heavy phase into at least one stream comprising insoluble coal products and one other overhead stream comprising solvent.

The insoluble coal products stream is withdrawn from the first solvent recovery zone through a conduit 46'' for introduction into subsequent processing apparatus (not shown). The solvent stream is withdrawn from the first solvent recovery zone 44'' through a conduit 48'' for eventual recycle to the first mixing zone 18'' and the second mixing zone 88.

The second heavy phase comprising heavy soluble coal products and some solvent is withdrawn from the second separation zone 34'' through a conduit 50'' and introduced into a second solvent recovery zone 52''. Preferably, the second solvent recovery zone 52'' comprises a flash vessel.

In the second solvent recovery zone 52'', the second heavy phase is treated to effect a separation of the second heavy phase into at least one stream comprising heavy soluble coal products and one other overhead stream comprising solvent.

The heavy soluble coal products stream is withdrawn from the second solvent recovery zone 52'' through a conduit 54'' and recovered. The solvent stream is withdrawn from the second solvent recovery zone 52'' through a conduit 56'' for eventual recycle to the mixing zone with other recovered solvent.

A portion of the withdrawn heavy soluble coal products in conduit 54'' is withdrawn through a conduit 80''. Any portion of all of the heavy soluble coal products flowing in conduit 80'' can be introduced through conduits 72'' or 94'' to provide the additive or a part thereof for mixing with the feed and solvent.

The third heavy phase comprising light soluble coal products and some solvent is withdrawn from the third separation zone 38'' through a conduit and introduced into a third solvent recovery zone 60''. The third solvent recovery zone 60'' can comprise a flash vessel or a fractional distillation vessel or the like.

In the third solvent recovery zone 60'', the third heavy phase is treated to effect a separation of the third heavy phase into at least one stream comprising light soluble coal products and one other overhead stream comprising solvent.

The solvent stream is withdrawn from the third solvent recovery zone 60'' through a conduit 64'' for eventual recycle to the first mixing zone 18'' or the second mixing zone 88 with other recovered solvent. The light soluble coal products are withdrawn from the third solvent recovery zone 60'' through a conduit 62'' and recovered.

A portion of the withdrawn light soluble coal products in conduit 62'' is withdrawn through a conduit 82''. Any portion or all of the light soluble coal products flowing in conduit 82'' can be introduced through conduits 70'' or 96 to provide the additive or a part thereof for mixing with the feed and solvent.

In those instances wherein the additive comprises a distillate fraction, the additive is separated in the third separation zone 38'' as a portion of the third light phase and recycled.

In those instances wherein the additive comprises a portion of the recovered heavy soluble coal products, the additive is separated in the second separation zone 34'' as a portion of the second heavy phase and eventually recovered.

In those instances wherein the additive comprises a portion of the recovered light soluble coal products, the additive is separated in the third separation zone 38'' as a portion of the third heavy phase and eventually recovered.

If the additive is a mixture of a portion of a distillate fraction, heavy soluble coal products or light soluble coal products, the individual components of the additive are recovered in the respective separation zones as described hereinabove.

For the purpose of illustrating the present invention, and not by way of limitation, feed mixtures are prepared by mixing residuum materials resulting from distillation of coal liquefaction products with a solvent comprising benzene in a ratio of about one part by weight of residuum to about 5 parts by weight of benzene at a pressure level in the range of from about 600 psig to about 1500 psig and at a temperature level in the range of from about 400 degrees F. to about 700 degrees F. The residuum was analyzed and found to have the analyses set forth in Table I below.

TABLE I

| | |
|---|---|
| Specific Gravity | |
| 60/60 | 1.34 |
| Proximate Analyses | |
| % Loss at 105° C. | 0.4 |
| % Volatile Matter | 44.9 |
| % Fixed Carbon | 41.3 |
| % Ash | 13.4 |
| Ultimate Analyses | |
| % Carbon | 74.3 |
| % Hydrogen | 5.3 |
| % Nitrogen | 1.5 |
| % Sulfur | 2.0 |
| % Oxygen (diff.) | 3.5 |

The prepared feed mixtures then are utilized in various test runs to demonstrate the effectiveness of the present invention. The results of such test runs are explained in greater detail in the following Examples.

EXAMPLE I

Two test runs are set forth to illustrate the present invention. In the first run, no additive is introduced into the deashing system. In the second run, an additive comprising a 350 degree F. to about 450 degree F. boiling point fraction separated within the distillation zone 12 is introduced into the mixing zone 18 in a ratio by weight of residuum feed to additive of about 1:1 as illustrated in FIG. 1.

In each run, the first separation zone 30 is maintained at a temperature level of about 525 degrees F. and a pressure level of about 800 psig to effect a separation of the feed mixture into a first light phase and a first heavy phase. Portions of the first light phase periodically are withdrawn from the first separation zone 30 through a conduit 32 and treated to recover the soluble coal products. It is determined that in the run in which the additive is not present, about 71.7 percent of the soluble coal products in the feed are recovered and contain less than 0.2 percent by weight insoluble coal products. By way of contrast, in the run in which the additive is introduced into the feed mixture in the mixing zone 12, in excess of 71.7 percent of the soluble coal products in the feed are recovered and contain less than 0.2 percent by weight insoluble coal products.

EXAMPLE II

Two test runs are set forth to illustrate the present invention. In the first run, no additive is introduced into the deashing system. In the second run, an additive comprising 50 percent light soluble coal products and 50 percent heavy soluble coal products is introduced into the mixing zone 12' in a ratio by weight of residuum feed to additive of about 1:1 as illustrated in FIG. 2.

In each run, the first separation zone 30' is maintained at a temperature level of about 525 degrees F. and a pressure level of about 800 psig to effect a separation of the feed mixture into a first light phase and a first heavy phase. Portions of the first light phase periodically are withdrawn from the first separation zone 30' through a conduit 32' and treated to recover the soluble coal products. It is determined that in the run in which the additive is not present, about 71.7 percent of the soluble coal products in the feed are recovered and contain less than 0.2 percent by weight insoluble coal products. By way of contrast, in the run in which the additive is introduced into the feed mixture in the mixing zone 12', in excess of 71.7 percent of the soluble coal products in the feed are recovered and contain less than 0.2 percent by weight insoluble coal products.

EXAMPLE III

Two test runs are set forth to illustrate the present invention. In the first run, no additive is introduced into the deashing system. In the second run, an additive comprising ⅓ light soluble coal products, ⅓ heavy soluble coal products and ⅓ a 350 degree F. to about 450 degree F. boiling point distillate fraction recovered from distillation zone 12''. The additive is introduced into the second mixing zone 88 in a ratio by weight of residuum feed to additive of about 1:1 and sufficient additional additive is introduced into the first mixing zone 18'' to also provide a ratio by weight of residuum feed to additive of about 1:1 therein as illustrated in FIG. 3.

In each run, the first separation zone 30'' is maintained at a temperature level of about 525 degrees F. and a pressure level of about 800 psig to effect a separation of the feed mixture into a first light phase and a first heavy phase and the fourth separation zone 100 is maintained at a temperature level of about 400 degrees F. and a pressure level of about 100 psig to effect a separation of the first heavy phase. Sufficient additional toluene is introduced into the second mixing zone 88 to provide a ratio by weight of residuum feed to solvent of about 1:5 therein. Portions of the first light phase periodically are withdrawn from the first separation zone 30'' and treated to recover the soluble coal products separated from the residuum feed. It is determined that in the run in which the additive is not present, about 74.1 percent of the soluble coal products in the feed are recovered and contain less than 0.2 percent by weight insoluble coal products. By way of contrast, in the run in which the additive is introduced into the first mixing zone 18'' and the second mixing zone 88, in excess of 74.1 percent of the soluble coal products in the feed are recovered and contain less than 0.2 percent by weight insoluble coal products.

What is claimed is:

1. A coal liquid deashing process comprising:

providing a feed comprising soluble coal products and insoluble coal products;

providing a solvent, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

providing an additive comprising recycled heavy soluble coal products;

admixing the feed, solvent and additive to form a mixture, said additive being present in said mixture in a quantity sufficient to provide a ratio by weight of feed to additive of from about 1:5 to about 20:1;

introducing said mixture into a first separation zone maintained at a temperature level in the range of from about 400 degrees F. to about 700 degrees F. and a pressure level in the range of from about 600 psig to about 1500 psig to effect a separation of said mixture into a first light phase and a first heavy phase comprising insoluble coal products and some solvent;

withdrawing said first light phase from said first separation zone, said first light phase containing soluble coal products extracted from the insoluble coal products by the interaction of said additive with said feed and solvent;

introducing said first light phase from said first separation zone into a second separation zone maintained at a temperature level above the temperature level of said first separation zone and a pressure level substantially no greater than the pressure level in said first separation zone to effect a separation of said first light phase into a second light phase comprising light soluble coal products and solvent and a second heavy phase comprising heavy soluble coal products and some solvent;

withdrawing said second heavy phase from said second separation zone as a product of the process; and recycling at least a portion of said heavy soluble coal products in said second heavy phase to provide said additive in said mixture being introduced into said first separation zone.

2. The process of claim 1 wherein the temperature and pressure maintained in said second separation zone is defined further as:

maintaining said second separation zone at a temperature level in the range of from about 450 degrees F. to about 800 degrees F. and a pressure level in the range of from about 600 psig to about 1500 psig.

3. A coal liquid deashing process comprising:

providing a feed comprising soluble coal products and insoluble coal products;

providing a solvent, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

providing an additive comprising recycled light soluble coal products;

admixing said feed, solvent and additive to form a mixture, said additive being present in said mixture in a quantity sufficient to provide a ratio by weight of feed to additive of from about 1:5 to 20:1;

introducing said mixture into a first separation zone maintained at a temperature level in the range of from about 400 degrees F. to about 700 degrees F. and a pressure level in the range of from about 600 psig to about 1500 psig to effect a separation of said mixture into a first light phase and a first heavy phase comprising insoluble coal products and some solvent;

withdrawing said first light phase from said first separation zone, said first light phase containing soluble coal products extracted from the insoluble coal products by the interaction of said additive with said feed and solvent;

introducing said first light phase from said first separation zone into a second separation zone maintained at a temperature level above the temperature level of said first separation zone and a pressure level substantially no greater than the pressure level in said first separation zone to effect a separation of said first light phase into a second light phase and a second heavy phase comprising heavy soluble coal products and some solvent;

introducing the second light phase from said second separation zone into a third separation zone;

separating said second light phase in said third separation zone into a third light phase comprising solvent and a third heavy phase comprising light soluble coal products;

withdrawing said third heavy phase from said third separation zone as a product of the process; and recycling at least a portion of said light soluble coal products to provide said additive in said mixture being introduced into said first separation zone.

4. The process of claim 3 in which said additive is defined further as an additive comprising a mixture of recycled light soluble coal products and recycled heavy soluble coal products, and said process is defined further to include the step of:

recycling at least a portion of said heavy soluble coal products in said second heavy phase to mix with said recycled light soluble coal products to provide said additive in said mixture being introduced into said first separation zone.

5. The process of claim 3 wherein the temperature and pressure maintained in said second separation zone is defined further as:

maintaining said second separation zone at a temperature level in the range of from about 450 degrees F. to about 800 degrees F. and a pressure level in the range of from about 600 psig to about 1500 psig.

6. The process of claim 3 wherein said mixture is defined further as:

admixing said feed, solvent and additive to form a mixture, said additive being present in said mixture in a quantity sufficient to provide a ratio by weight of feed to additive of from 1:1 to about 15:1.

7. The process of claim 3 wherein said third separation zone is defined further as a flash vessel, and separating said second light phase is defined further as:

flashing said second light phase to produce said light soluble coal products and an overhead stream comprising solvent.

8. The process of claim 3 wherein separating said second light phase is defined further as:

maintaining said third separation zone at a temperature level in the range of from about 500 degrees F. to about 950 degrees F. and a pressure level in the range of from about 600 psig to about 1500 psig to effect a separation of said second light phase into said third light phase and said third heavy phase.

9. A coal liquid deashing process comprising:

providing a feed comprising soluble coal products and insoluble coal products;

providing a solvent, said solvent consisting essentially of at least one substance having a critical temperature below 180 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

providing an additive, said additive comprising at least two members selected from the group consisting of (i) recycled light soluble coal products, (ii) recycled heavy soluble coal products and (iii) a distillate fraction containing volatile coal products derived by coal liquefaction;

admixing the feed, solvent and a first portion of the additive to form a first mixture, said additive being present in said mixture in a quantity sufficient to provide a ratio by weight of feed to additive of from about 1:5 to about 20:1;

introducing the first mixture into a first separation zone;

maintaining the first separation zone at a temperature level in the range of from about 400 degrees F. to about 700 degrees F. and a pressure level in the range of from about 600 psig to about 1500 psig to effect a separation of the first mixture into a first light phase comprising soluble coal products, additive and solvent and a first heavy phase comprising insoluble coal products, some soluble coal products, some additive and some solvent;

admixing the first heavy phase from said first separation zone with a second portion of said additive to provide a ratio by weight of feed to additive of from about 1:5 to about 10:1 to form a second mixture;

introducing the second mixture into a second separation zone;

maintaining the second separation zone at a temperature level in the range of from about 200 degrees F. to about 700 degrees F. and a pressure level in the range of from about atmospheric pressure to about 1500 psig to effect a separation of the second mixture into a second light phase comprising additive, solvent and soluble coal products extracted from the insoluble coal products by the interaction of the additive with the feed and solvent and a second heavy phase comprising insoluble coal products and some solvent;

recycling the second light phase from said second separation zone to admix with said first mixture prior to entry into the first separation zone to provide solvent, soluble coal products and additive to said first mixture which is being introduced into said first separation zone; and withdrawing the first light phase from the first separation zone, said first light phase comprising soluble coal products comprising light soluble coal products and heavy soluble coal products extracted from the insoluble coal products by the interaction of the additive with the feed and solvent.

10. The process of claim 9 wherein said first mixture is defined further as:

admixing the feed, solvent and a first portion of the additive to form a first mixture, said additive preferably present in said mixture in a quantity sufficient to provide a ratio by weight of feed to additive of from about 1:1 to about 15:1.

11. The process of claim 9 defined further to include the steps of:

introducing the first light phase into a third separation zone;

maintaining the third separation zone at a temperature level in the range of from about 450 degrees F. to about 800 degrees F. and a pressure level in the range of from about 600 psig to about 1500 psig to effect a separation of the first light phase into a third light phase and a third heavy phase comprising said heavy soluble coal products;

withdrawing the third light phase from the third separation zone; and withdrawing the third heavy phase as a product of said process.

12. The process of claim 11 defined further to include the steps of:

introducing the withdrawn third light phase into a fourth separation zone;

separating the withdrawn third light phase into a fourth light phase comprising solvent and a fourth heavy phase comprising light soluble coal products;

withdrawing the fourth light phase from the fourth separation zone for recycle to provide solvent to said first mixture; and withdrawing the fourth heavy phase from the fourth separation zone as a product of said process.

13. The process of claim 12 wherein separating the third light phase is defined further as:

maintaining the fourth separation zone at a temperature level in the range of from about 500 degrees F. to about 950 degrees F. and a pressure level in the range of from about 600 psig to about 1500 psig.

14. The process of claim 12 wherein the fourth separation zone is defined further as a flash vessel, and separating the third light phase is defined further as:

flashing the third light phase to produce said light soluble coal products and an overhead stream comprising solvent.

* * * * *

UNITED STATES PATENT AND TRADEMARK OFFICE

CERTIFICATE OF CORRECTION

PATENT NO. : 4,177,135

DATED : December 4, 1979

INVENTOR(S) : Donald E. Rhodes

It is certified that error appears in the above-identified patent and that said Letters Patent are hereby corrected as shown below:

Column 16, line 55, "180 degrees F." should read

-- 800 degrees F. --

Signed and Sealed this

*Twelfth* Day of *August 1980*

[SEAL]

*Attest:*

SIDNEY A. DIAMOND

*Attesting Officer*

*Commissioner of Patents and Trademarks*